US006107748A

United States Patent [19]

Schmied

[11] Patent Number: 6,107,748

[45] Date of Patent: Aug. 22, 2000

[54] CIRCUIT ARRANGEMENT OF A FINAL IGNITION STAGE

[75] Inventor: Helmut Schmied, Marbach, Germany

[73] Assignee: Robert Bosch GmbH, Stuttgart, Germany

[21] Appl. No.: 09/381,251

[22] Filed: Dec. 1, 1999

[30] Foreign Application Priority Data

Mar. 18, 1997 [DE] Germany ..... 197 11 204

[51] Int. Cl.[7] ..... H05B 37/02

[52] U.S. Cl. ..... 315/209 T; 361/249; 361/253

[58] Field of Search ..... 315/209 T; 123/618, 123/623; 323/305, 311, 901; 361/247, 249, 253

[56] References Cited

U.S. PATENT DOCUMENTS

| | | | |
|---|---|---|---|
| 4,046,124 | 9/1977 | Long | 315/209 T |
| 4,051,827 | 10/1977 | Capurka et al. | 315/209 T |
| 4,461,979 | 7/1984 | Jeenicke et al. | 315/209 T |
| 5,019,779 | 5/1991 | Ookawa | 361/253 |
| 5,107,392 | 4/1992 | Sohner et al. | 123/623 |
| 5,723,916 | 3/1998 | Disney et al. | 361/247 |
| 5,936,830 | 8/1999 | Rousseau et al. | 361/253 |
| 5,992,401 | 11/1999 | Bylsma et al. | 361/247 |
| 6,018,202 | 1/2000 | Meinders et al. | 361/253 |

*Primary Examiner*—Don Wong
*Assistant Examiner*—Thuy Vinh Tran
*Attorney, Agent, or Firm*—Kenyon & Kenyon

[57] ABSTRACT

A circuit arrangement of an ignition output stage in particular for an ignition circuit of a motor vehicle, having a switching arrangement which triggers a primary winding of an ignition coil, and a trigger circuit for the switching arrangement. The trigger circuit allows a two-stage closing of the ignition coil.

10 Claims, 3 Drawing Sheets

CIRCUIT ARRANGEMENT OF A FINAL IGNITION STAGE

FIELD OF THE INVENTION

The present invention relates to a circuit arrangement for an ignition output stage, in particular for and automobile ignition circuit.

BACKGROUND INFORMATION

It is known in ignition systems, in particular in single plug or distributor less multiple plug ignition systems, that the spark plugs can be directly connected to a secondary winding of the ignition coil. The secondary winding of the ignition coil cooperates with a primary winding of the ignition coil which is controllable through a switching means. A drawback is that upon energizing the primary current, a high voltage is induced in the secondary winding which at energizing time can result in the occurrence of an ignition spark at the spark plug. This energizing ignition spark is undesired since it can result in damage to an internal combustion engine having the ignition system.

An ignition system for internal combustion engines is described in European Patent Application No. 0 244 633 in which the primary winding is triggered by a trigger circuit which influences a rise in the current of the primary winding. In this manner, the occurrence of an energizing ignition spark is countered. A disadvantage of this conventional circuitry is that it is relatively costly.

SUMMARY OF THE INVENTION

The circuit arrangement according to the present invention is advantageous in that an energizing ignition spark can be suppressed using simple means, which are easy to integrate into an existing trigger circuit. Because the trigger circuit allows a two-stage energizing of the ignition coil, it is possible in a simple manner to limit the primary current during energizing time and thus to prevent the transmission of a primary voltage jump to the secondary coil.

In one embodiment in the present invention, the two-stage energizing takes place via a timing element so that the changeover time from the first into the second switching state can be specified in a definite manner. The changeover preferably takes place at a time at which the secondary voltage of the secondary coil is in the process of decaying following connection to the energizing current of the first switching stage. Through this triggering of the primary coil in defined intervals offset in time to each other, the attainment of the necessary secondary voltage for the spark plug is assured without an ignition spark occurring in advance at energizing time as a result of the primary voltage jump at the energizing time.

DETAILED DESCRIPTION

Figure 1:
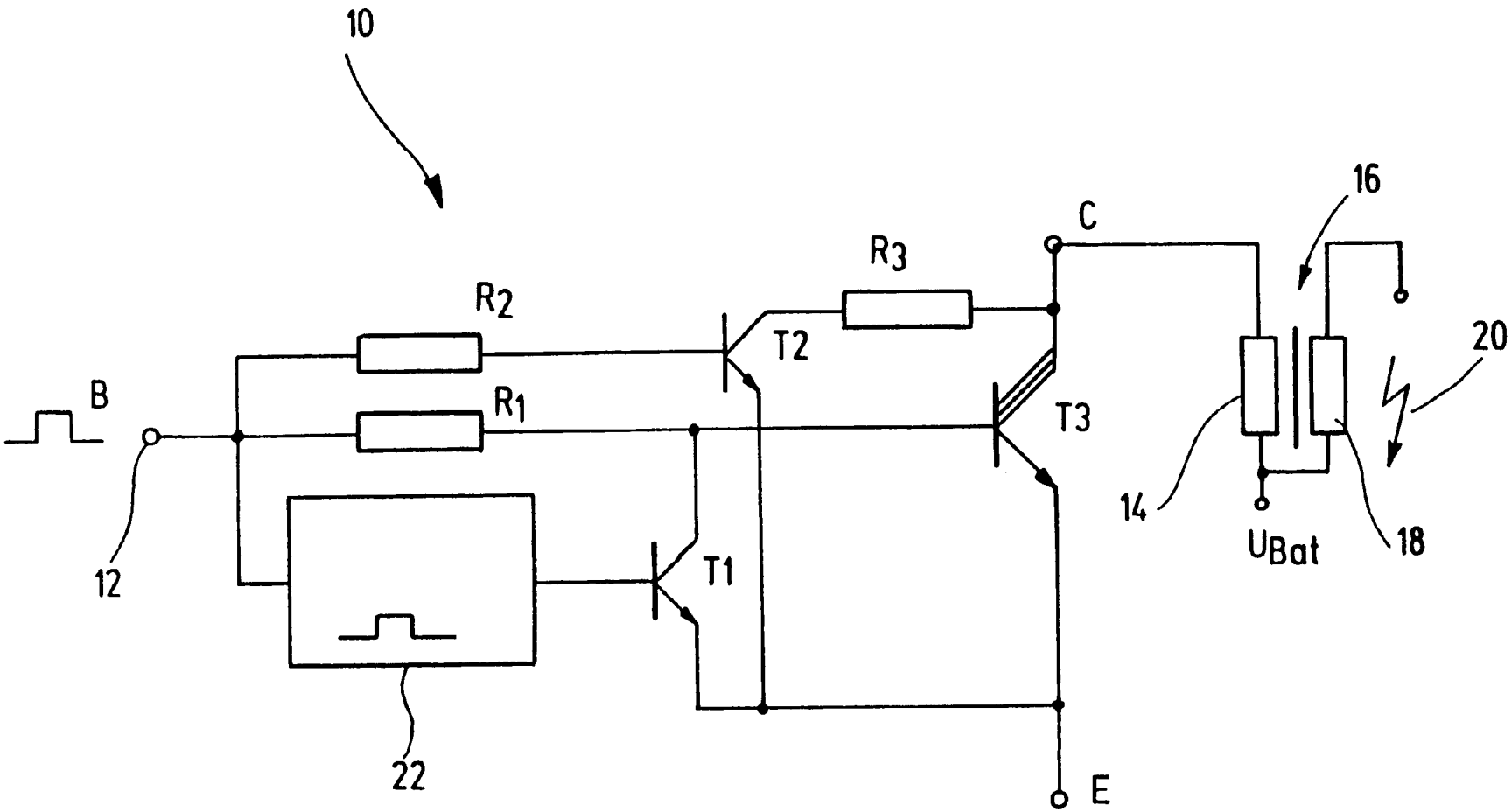
FIG. 1 shows a block diagram of an exemplary embodiment of an ignition output stage according to the present invention.

FIG. 1 shows a circuit arrangement 10 of an ignition output stage of an internal combustion engine. In FIG. 1, only one ignition output stage is shown, while depending on the number of cylinders of the internal combustion engine, a corresponding number of ignition output stages are provided.

At an input terminal 12, which is assigned to the base of a switching transistor T3, the output signal of an engine control is applied. Terminal 12 is connected across a resistor R1 to the base of transistor T3. Transistor T3 is configured as a multiple Darlington transistor stage. The collector of transistor T3 is connected to primary coil 14 of an ignition coil 16, at the other terminal of which a supply voltage, for example voltage $U_{bat}$ of an automobile battery, is applied. Ignition coil 16 has a secondary coil 18, whose one terminal is also at the supply voltage and whose other terminal is connected to a spark plug 20 that is only indicated. Emitter C of transistor T3 is connected to ground.

Input terminal 12 is further connected across a resistor R2 to the base of a transistor T2. The collector of transistor T2 is connected across a resistor R3 to collector C of transistor T3. The emitter of transistor T2 is connected to emitter E of transistor T3.

In addition, input terminal 12 is connected to an input of a timing element 22, whose output is connected to the base of a transistor T1. The collector of transistor T1 is connected to the base of transistor T3, and the emitter of transistor T1 is connected to emitter E of transistor T3.

The circuit arrangement shown in FIG. 1 performs the following function:

Transistors T2 and T1 are activated with an input signal at input terminal 12 so that they immediately become conductive. Activated transistor T1 in this process blocks transistor T3 through the connection of the collector of transistor T1 to the base of transistor T3. The connection of primary coil 14 to ground across collector terminal C takes place through activated transistor T2 and resistor R3 which is connected in series with it. Resistor R3 is selected to have high resistance, that is, it has a resistance which is significantly greater than the resistance of primary coil 14.

Transistor T3 is for practical purposes bridged over by transistor T2 and resistor R3.

After passage of a preset time on timing element 22, transistor T1 is blocked so that transistor T3 is thereby activated. The connection between the voltage source and primary coil 14 of ignition coil 16 now takes place through transistor T3, with the connection across resistor R3 and transistor T2 being negligible due to the high resistance of resistor R3. Through suitable measures, however, transistor T2 can also be blocked simultaneously with the switching on of transistor T3. At the moment of ignition of spark plug 20, transistors T2 and T3 are blocked. Any bracketing which may be necessary is assumed by transistor T3 in a manner not shown.

Figure 2:
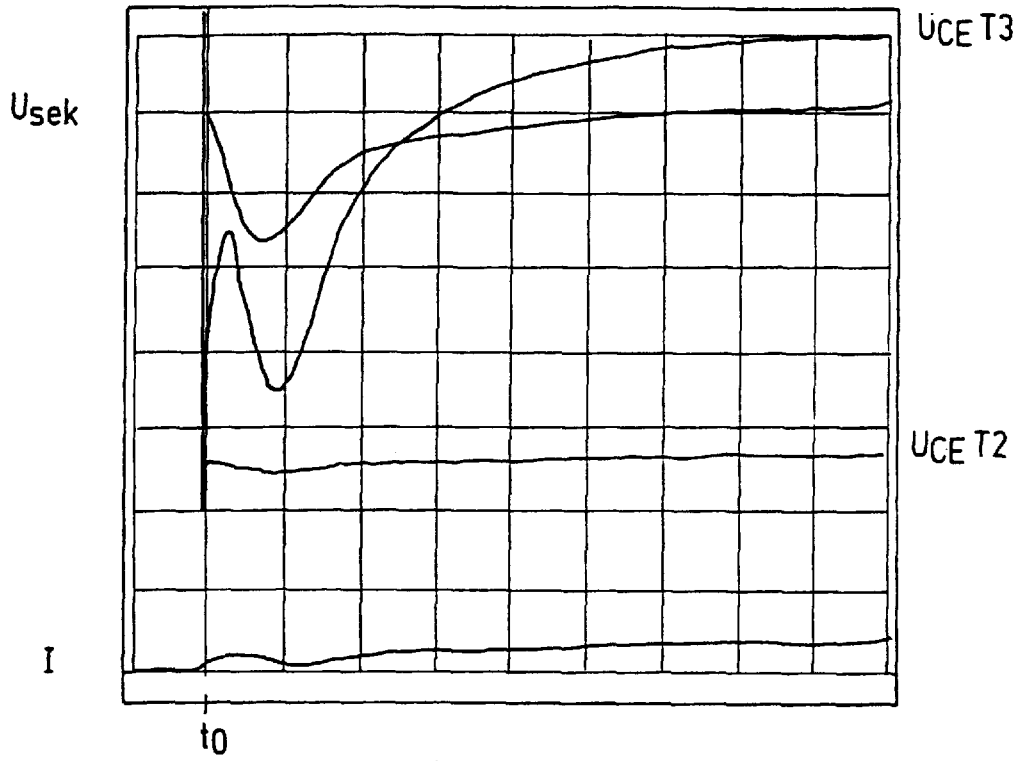
FIG. 2 show a first example of a voltage and current graph (as a function of time) of the ignition output stage.
Figure 3:
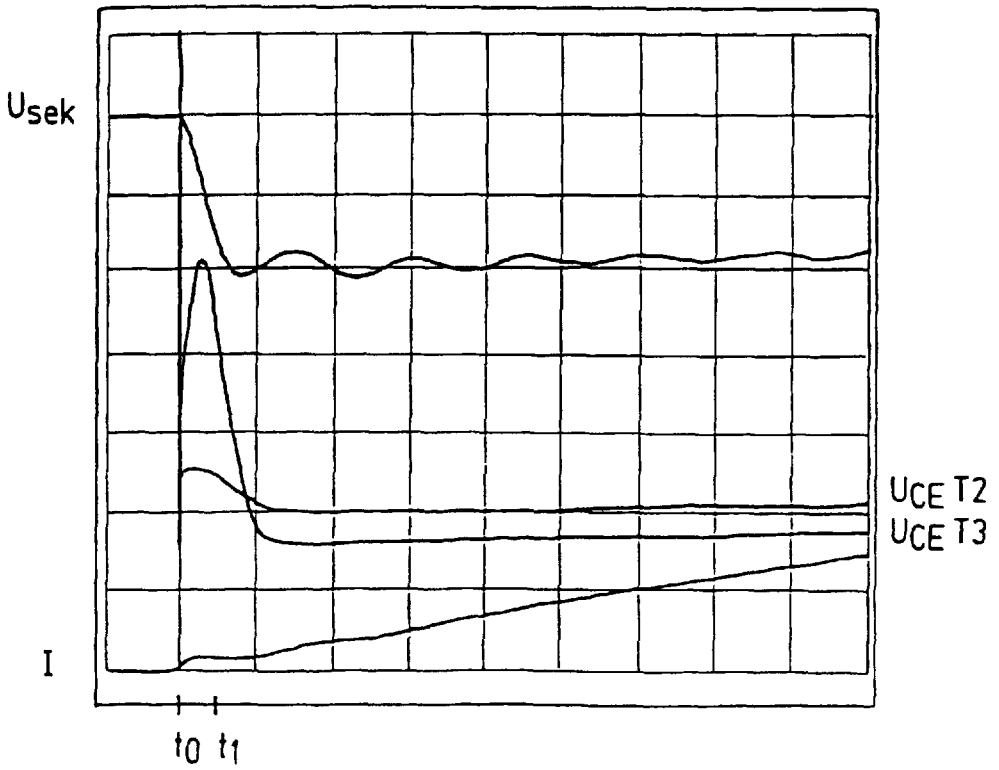
FIG. 3 show a second example of the voltage and current graph of the ignition output stage.

In FIGS. 2 and 3, the curves of the collector-emitter voltages of transistor T2 $U_{CE}$ T2 and of transistor T3 $U_{CE}$ T3, ignition coil current I, and the secondary voltage of ignition coil $U_{sek}$ are shown. In FIG. 2, the energizing time, i.e., time $t_0$ at which the output signal of the engine control is applied to input terminal 12, is depicted. It is clear that voltage $U_{CE}$ T3 does not rise according to an E function, but rather initially exhibits an oscillation, although transistor T2 remains conductive, as is made clear by voltage curve $U_{CE}$ T2. This oscillation results from the influence of the winding capacitance and line capacitance in the secondary circuit on the primary side of ignition coil 16. The frequency of this oscillation of voltage curve $U_{CE}$ T3 is independent of the supply voltage, i.e., the voltage of the automobile battery. The voltage curves shown in FIG. 2 would be obtained if transistor T3 were continuously blocked. Due to the delayed closing of transistor T3 across timing element 22—as explained with reference to FIG. 1—at time $t_1$, the voltage and current curves illustrated in FIG. 3 are obtained. Time $t_1$ is in the phase of the decaying primary voltage at a point in time approximately 30 $\mu$s after time $t_0$. Since transistor T3 is activated at this point, voltage $U_{CE}$ T2 drops subsequently almost to 0, since as a result of the high-resistance resistor R3 practically no more current flows across transistor T2 and resistor R3.

The curve of secondary voltage $U_{sek}$ makes it clear that at the energizing time or shortly after energizing time $t_C$ the secondary voltage does not rise to a value which can cause an uncontrolled ignition sparking of spark plug 20. The value of secondary voltage $U_{sek}$ is dependent on the transformation ratio of ignition coil 16 and does not exceed 1 kV during the entire current ramp.

Figure 4:
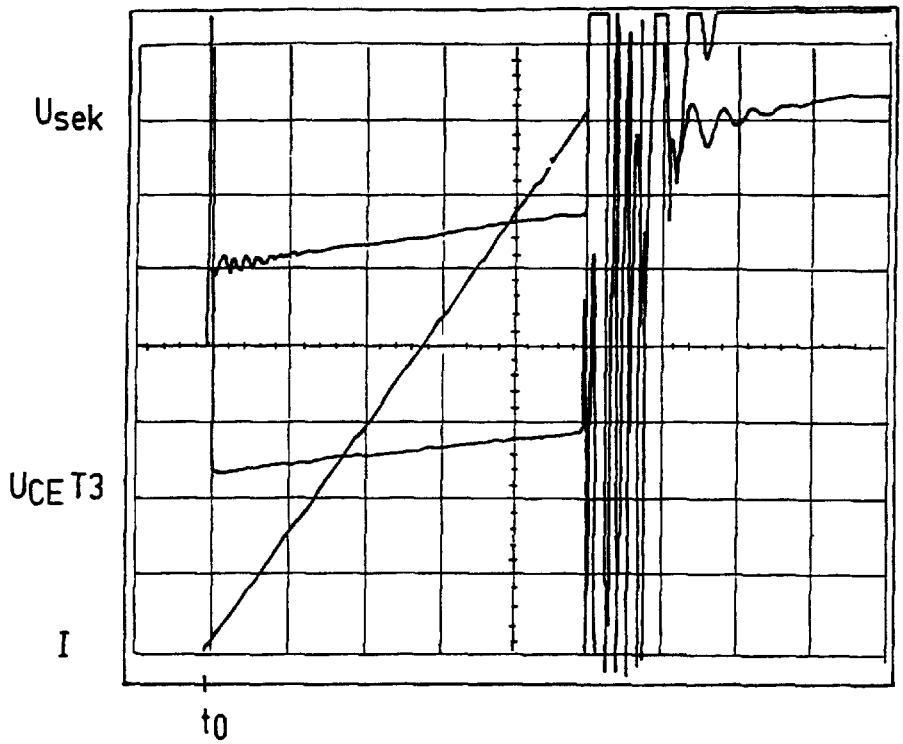
FIG. 4 show a third example of the voltage and current graph of the ignition output stage.
Figure 5:
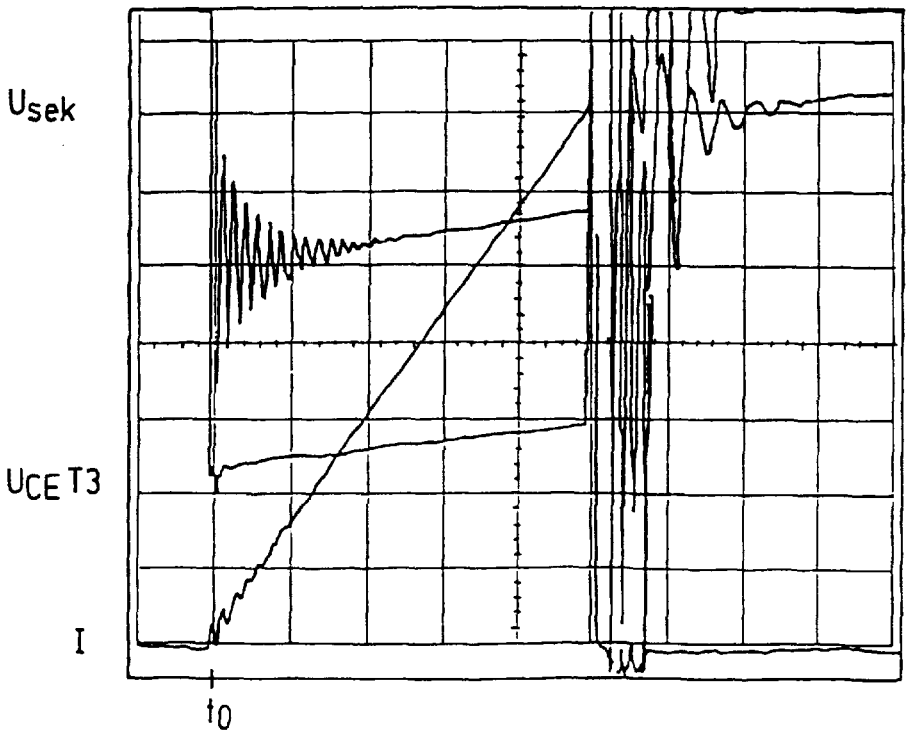
FIG. 5 show a fourth example of the voltage and current graph of the ignition output stage.

In FIGS. 4 and 5, the curve of the voltages and the ignition current is illustrated again in a comparison of the relationships in an ignition output stage having the circuit arrangement with reference to the present invention according to FIG. 1 (FIG. 4) and an ignition output stage that does not have the two-stage closing of the ignition coil. It is clear that secondary voltage $U_{sek}$ in the case of non-two-stage closing (FIG. 5) experiences a rise and gradual decay of the secondary voltage jump due to the transmission of the primary voltage jump elicited by $U_{CE}$ T3, with the peak value of the secondary voltage jump being greater than induced voltage $U_{sek}$ during the rise of ignition coil current I. These voltage peaks can result in uncontrolled ignition sparks at ignition coil 20. According to the curve of secondary voltage $U_{sek}$, these voltage peaks do not occur with a two-stage closing of the ignition coil illustrated in FIG. 4.

What is claimed is:

1. A circuit arrangement of an ignition output stage, comprising:

a switching arrangement which switches between an ON state and an OFF state to selectively switch a particular current through a primary winding of an ignition coil between an ON state and an OFF state;

a trigger circuit cooperating with the switching arrangement and causing a two-stage activation of the particular current through the primary winding of the ignition coil; and a switchable high-resistance parallel branch arrangement bridging the switching arrangement and carrying a limited current, wherein, at an energizing time which is determined independently from the trigger circuit, the trigger circuit blocks the switching arrangement from receiving the particular current which flows through the primary winding, wherein, at the energizing time, the switchable high-resistance parallel branch arrangement is switched on, and wherein, at a predetermined changeover time which occurs after the energizing time, the trigger circuit removes a block of the switching arrangement to receive the particular current.

2. The circuit arrangement according to claim 1, wherein the trigger circuit includes an auxiliary transistor which has a triggering timing element, wherein the auxiliary transistor generates the block of the switching arrangement, and wherein the trigger circuit activates the timing element at the energizing time and deactivates the timing element at the predetermined changeover time.

3. The circuit arrangement according to claim 1, wherein the switchable high-resistance parallel branch arrangement includes a high-resistance resistor which bridges the switching arrangement at the energizing time.

4. The circuit arrangement according to claim 1, wherein the switching arrangement includes a Darlington switching transistor.

5. The circuit arrangement according to claim 4, wherein the trigger circuit includes an auxiliary transistor which bridges a base-emitter path of the Darlington switching transistor to block the switching arrangement.

6. The circuit arrangement according to claim 4, wherein the trigger circuit detects a decaying voltage at a collector terminal of the Darlington switching transistor for allowing the particular current to flow through the primary winding of the ignition coil.

7. The circuit arrangement according to claim 1, wherein the predetermined changeover time is within a decay phase of a primary voltage induced in the ignition coil when the switchable high-resistance parallel branch arrangement is energized.

8. The circuit arrangement according to claim 1, wherein the predetermined changeover time is approximately 30 $\mu$seconds after the energizing time.

9. The circuit arrangement according to claim 1, wherein the trigger circuit includes a transistor which connects the switchable high-resistance parallel branch arrangement to the switching arrangement, the transistor operating outside of a saturation.

10. The circuit arrangement according to claim 1, wherein the circuit arrangement is provided for an ignition circuit of a motor vehicle.

* * * * *